US005939655A

United States Patent [19]

Sato

[11] Patent Number: 5,939,655

[45] Date of Patent: Aug. 17, 1999

[54] APPARATUS AND METHOD FOR GENERATING MUSICAL TONES WITH REDUCED LOAD ON PROCESSING DEVICE, AND STORAGE MEDIUM STORING PROGRAM FOR EXECUTING THE METHOD

[75] Inventor: Hiroyuki Sato, Hamamatsu, Japan

[73] Assignee: Yamaha Corporation, Hamamatsu, Japan

[21] Appl. No.: 08/933,466

[22] Filed: Sep. 18, 1997

[30] Foreign Application Priority Data

Sep. 20, 1996 [JP] Japan ..... 8-269098

[51] Int. Cl.[6] ..... G10H 1/02; G10H 1/08

[52] U.S. Cl. ..... 84/625; 84/626; 84/660; 84/662

[58] Field of Search ..... 84/622–625, 659–661, 84/692–700, 601–607, 626–633, 662–665

[56] References Cited

U.S. PATENT DOCUMENTS

| | | | |
|---|---|---|---|
| 4,920,850 | 5/1990 | Matsumoto et al. | 84/625 X |
| 5,094,136 | 3/1992 | Kudo et al. | 84/624 X |
| 5,192,824 | 3/1993 | Shibukawa | 84/625 X |
| 5,243,123 | 9/1993 | Chaya | 84/625 |
| 5,256,830 | 10/1993 | Takeuchi et al. | 84/625 |
| 5,319,151 | 6/1994 | Shiba et al. | 84/603 |
| 5,354,948 | 10/1994 | Toda | 84/625 X |
| 5,468,906 | 11/1995 | Colvin et al. | 84/625 X |
| 5,596,159 | 1/1997 | O'Connell | 84/622 |
| 5,698,805 | 12/1997 | Thompson et al. | 84/625 X |
| 5,714,703 | 2/1998 | Wachi et al. | 84/603 |
| 5,750,911 | 5/1998 | Tamura | 84/602 |
| 5,808,221 | 9/1998 | Ashour et al. | 84/603 |

*Primary Examiner*—Stanley J. Witkowski
*Attorney, Agent, or Firm*—Graham & James LLP

[57] ABSTRACT

A musical tone generating apparatus has a processing device that produces either musical tone synthesis parameters or musical tone waveform data corresponding to input performance data, depending upon a type of the input performance data. An encoder/decoder circuit includes a tone generator circuit that generates musical tone waveform data in accordance with the musical tone synthesis parameters produced by the processing device, a buffer circuit storing the musical tone waveform data produced by the processing device, a mixing circuit that mixes the musical tone waveform data produced by the tone generator circuit and the musical tone waveform data stored in the buffer circuit, and a conversion circuit that converts mixed musical tone waveform data generated from the mixing circuit into a musical tone signal.

8 Claims, 7 Drawing Sheets

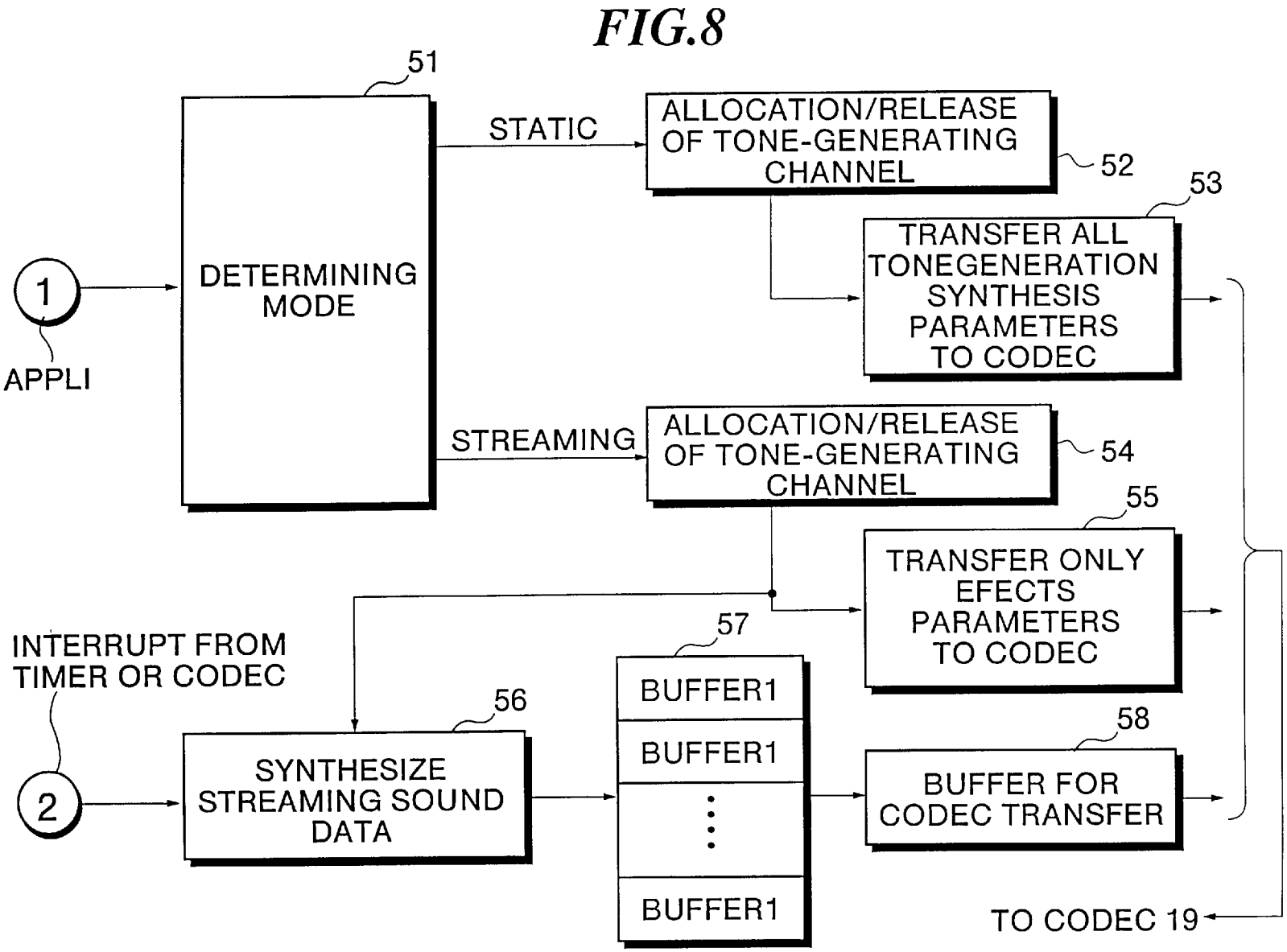
FIG.8
51
DETERMINING MODE
STATIC
STREAMING
52
ALLOCATION/RELEASE OF TONE-GENERATING CHANNEL
53
TRANSFER ALL TONEGENERATION SYNTHESIS PARAMETERS TO CODEC
54
ALLOCATION/RELEASE OF TONE-GENERATING CHANNEL
55
TRANSFER ONLY EFECTS PARAMETERS TO CODEC
56
SYNTHESIZE STREAMING SOUND DATA
57
BUFFER1
BUFFER1
BUFFER1
58
BUFFER FOR CODEC TRANSFER
TO CODEC 19
1
APPLI
INTERRUPT FROM TIMER OR CODEC
2

APPARATUS AND METHOD FOR GENERATING MUSICAL TONES WITH REDUCED LOAD ON PROCESSING DEVICE, AND STORAGE MEDIUM STORING PROGRAM FOR EXECUTING THE METHOD

BACKGROUND OF THE INVENTION

1. Field of the Invention

The present invention relates to an apparatus and method for generating musical tones, using a general-purpose processing apparatus such as a personal computer, and also relates to a method of generating musical tones, and a storage medium storing a program that carries out the same method.

2. Prior Art

In a general-purpose processing apparatus such as a personal computer, musical tones were conventionally generated by using an exclusive tone generator device provided externally of the apparatus, or, by using an expansion board connected to the apparatus and having several IC chips mounted thereon, such as a tone generator chip for generating musical tone waveforms, a ROM that stores waveform data, and a coder/decoder circuit (CODEC) chip equipped with an A/D conversion circuit (analog-to-digital converter), a D/A conversion circuit (digital-to-analog converter; DAC), a FIFO (first-in first-out) buffer, and an interface circuit.

With an increased processing speed of recent CPUs, so-called software tone generators have become used which synthesize musical tones with software using a CPU according to performance information. Such a software tone generator is able to generate musical tones only with a D/A conversion circuit and a FIFO buffer in addition to the CPU and software, without using an exclusive tone generator device or expansion board as described above.

In such a software tone generator, musical tones are normally synthesized by repeatedly reproducing a short period of musical tone waveform data. In one method, for example, musical tones are generated by storing musical tone waveform samples such as WAVE data in a waveform memory, reading out the musical tone waveform samples corresponding to performance information from the waveform memory, and performing specific processing on these waveform samples. In another method, a tone generator of waveform memory type is simulated. A software tone generator that simulates the waveform memory type tone generator produces musical tone waveform data corresponding to one round of sampling timing, by executing for each tone-generating channel waveform operations of LFO (low frequency oscillator), filter EG (envelope generator), and volume EG and the like, based on musical tone control information produced from performance information such as MIDI data, reading out waveform data from a corresponding waveform memory (waveform table), performing an interpolating operation on the waveform data thus read out, computing and producing waveform data for the relevant tone-generating channel by multiplying the thus obtained waveform data by a sample of each type of EG waveform, and accumulating waveform sample data for each tone-generating channel by repeatedly executing the above operations for all tone-generating channels. In the following, such a musical tone generating mode in which a short period of waveform data is repeatedly used shall be called static mode for convenience sake, and the short period of musical tone waveform data produced in this manner shall be called static sound data.

It is also possible to reproduce a large volume of musical tone waveform sample data stored in a hard disk device, CD-ROM, or the like, by using hardware, namely, a D/A conversion circuit and FIFO buffer, necessary in the above-mentioned software tone generator. In this method, which is different from the above-described method in which waveform samples stored in the waveform memory are repeatedly used, musical tone waveform samples stored in a large-capacity storage medium are sequentially read out, and converted from digital signals into analog signals every sampling period, so that a stream of these samples are all reproduced. In the following, such a musical tone generating mode in which all the waveform samples are reproduced as above shall be called streaming mode for convenience sake, and a series of musical tone waveform data generated in this manner shall be called streaming sound data.

The above-described two sound tone generating modes may be employed in the musical tone generating apparatus using the general-purpose processing apparatus. Although each of the two modes may be used alone, these two modes are normally used in a mixed manner such that the static mode is used for some musical tones while the streaming mode is used for other musical tones.

Referring to FIG. 1A, the manner of reproducing sound data generated by such a musical sound generating apparatus will be explained. In FIG. 1A, buffer areas 101–10*n* are provided in a main memory, to respectively correspond to n tone-generating channels in this musical tone generating apparatus. Some of the n tone-generating channels are adapted to generate musical tones in the static mode as described above, and static sound data are stored in the buffer areas corresponding to these channels. Also, the above-described streaming sound data are stored in the buffer areas corresponding to the other tone-generating channels. The sound data stored in these buffer areas 101–10*n* are mixed and stored in a buffer 110 for transferring data to CODEC.

The musical tone waveform data stored in the CODEC transfer buffer 110 is transferred to a CODEC (not shown) every predetermined period, transmitted to a D/A converter every sampling period, and then converted by the D/A converter into analog signals, which are then generated as musical tone signals.

FIG. 1B is a view for explaining the processing for reproducing the above-mentioned static sound data. First, a short period of sound data (musical tone waveform data or waveform sample) which is stored in a large-capacity storage device 120, such as a hard disk device or CD-ROM device, or ROM, is transferred only once to a sound data storage area (waveform memory) provided in a main memory 130. Then, the short period of sound data stored in the sound data storage area is repeatedly read out to be synthesized into musical tone waveform data (static sound data) as described above, and then transferred to the buffer 10*i* of the relevant tone-generating channel. The sound data transferred to this buffer 10*i* is mixed with data stored in buffers corresponding to other tone-generating channels, and is stored in the buffer 110 for transferring data to CODEC, as shown in FIG. 1A.

FIG. 1C is a view for explaining the processing for reproducing the above-mentioned streaming sound data. In this case, a large volume of sound data stored in a large-capacity storage device 120, such as a hard disk device, are sequentially read out and written into a buffer area provided in a main memory 130. This buffer area is configured as a so-called double buffer, from which sound data is read out in parallel with writing of sound data thereinto, and sequentially transferred to a buffer 10*j* corresponding to the relevant channel. The data in this buffer 10*j* is mixed with data in the other channels as described above and is further transferred to the buffer 110 for transferring data to CODEC.

The generation of musical tones by software using such a general-purpose processing apparatus as described above causes a great processing load on the CPU. When developing an application program such as game software that requires many tone-generating channels, therefore, it was unavoidable or necessary to reduce the number of tone-generating channels or lower the quality of musical tones generated. It was also impossible to perform sophisticated processing, such as processing for applying effects to the musical tones generated.

SUMMARY OF THE INVENTION

It is therefore an object of the invention to provide an apparatus and method for generating musical tones, which reduces the load required for synthesis processing of static sound data, by using less hardware, thus permitting an increase in the number of tone-generating channels and improving the quality of musical tones generated, and a storage medium that stores a program for carrying out the method.

To attain the above object, the present invention provides a musical tone generating apparatus comprising an input device that receives input performance data, a processing device that produces either musical tone synthesis parameters or musical tone waveform data corresponding to the input performance data, depending upon a type of the received input performance data, a tone generator circuit that generates musical tone waveform data in accordance with the musical tone synthesis parameters produced by the processing device, and a conversion circuit that mixes the musical tone waveform data produced by the processing device and the musical tone waveform data produced by the tone generator circuit, and converts the mixed musical tone waveform data into a musical tone signal.

Preferably, the input performance data includes at least a first performance data and a second performance data, and when the input performance data is the first performance data, the processing device produces the musical tone synthesis parameters corresponding to the input performance data and supplies the parameters to the tone generator circuit, and when the input performance data is the second performance data, the processing device produces the musical tone waveform data corresponding to the input performance data.

Also preferably, the tone generator circuit produces the musical tone waveform data by repeatedly using a short period of waveform data based on the musical tone synthesis parameters from the processing device. The musical tone generating apparatus further comprises a storage device that stores the musical tone waveform data produced by the processing device, and the processing device produces the musical tone waveform data by sequentially reading out the musical tone waveform data from the storage device.

More preferably, the musical tone generating apparatus further comprises an effects circuit for respectively applying predetermined effects to the musical tone waveform data produced by the processing device and the musical tone waveform data produced by the tone generator circuit.

In a preferred embodiment of the invention, the musical tone generating apparatus comprises an input device that receives input performance data, a processing device that produces either musical tone synthesis parameters or musical tone waveform data corresponding to the input performance data, depending upon a type of the received input performance data, an encoder/decoder circuit including a tone generator circuit that generates musical tone waveform data in accordance with the musical tone synthesis parameters produced by the processing device, a buffer circuit storing the musical tone waveform data produced by the processing device, a mixing circuit that mixes the musical tone waveform data produced by the tone generator circuit and the musical tone waveform data stored in the buffer circuit, and a conversion circuit that converts mixed musical tone waveform data generated from the mixing circuit into a musical tone signal.

Preferably, the encoder/decoder circuit further includes an effects circuit for respectively applying predetermined effects to the musical tone waveform data produced by the tone generator circuit and the musical tone waveform data stored in the buffer circuit.

To attain the above object, the present invention also provides a musical tone generating method comprising the steps of a) inputting performance data, b) producing musical tone synthesis parameters corresponding to the input performance data and supplying the musical tone synthesis parameters to a tone generator circuit for producing musical tone waveform data in accordance with the musical tone synthesis parameters, or producing musical tone waveform data corresponding to the input performance data, depending upon a type of the input performance data, c) mixing the musical tone waveform data produced by the tone generator circuit and the musical tone waveform data produced in the step b), and d) converting the mixed musical tone waveform data into a musical tone signal.

To attain the above object, the present invention further provides a storage medium storing a program executable by a computer, comprising a) a module that inputs performance data, and b) a module that produces musical tone synthesis parameters corresponding to the input performance data and supplies the musical tone synthesis parameters to a tone generator circuit for producing musical tone waveform data in accordance with the musical tone synthesis parameters, or producing musical tone waveform data corresponding to the input performance data, depending upon a type of the input performance data.

With the above construction, according to the invention, when the input performance data is the first performance data obtained by repeatedly using a short period of musical tone waveform data, the tone generator circuit provided in the encoder/decoder circuit synthesize desired musical tone waveform data. When the input performance data is the second performance data obtained by reproducing a large volume of musical tone waveform data, the processing device (CPU) produces the musical tone waveform data on software, thus reducing the load on the processing device for synthesizing the musical tone waveform data corresponding to the first performance data. Also, desired effects can be applied or imparted to the musical tone waveform data of each tone-generating channel that is synthesized by the tone generator circuit and the musical tone waveform data produced on software, respectively, thus making it possible to perform sophisticated or subtle effects processing.

The above and other objects, features, and advantages of the invention will become more apparent from the following detailed description taken in conjunction with the accompanying drawings.

BRIEF DESCRIPTION OF THE DRAWINGS

FIG. 8 is a view useful in explaining tone generation start/end processing and tone generator processing according to the embodiment.

DETAILED DESCRIPTION

The invention will be now described with reference to the drawings showing an embodiment thereof.

Figure 1A:
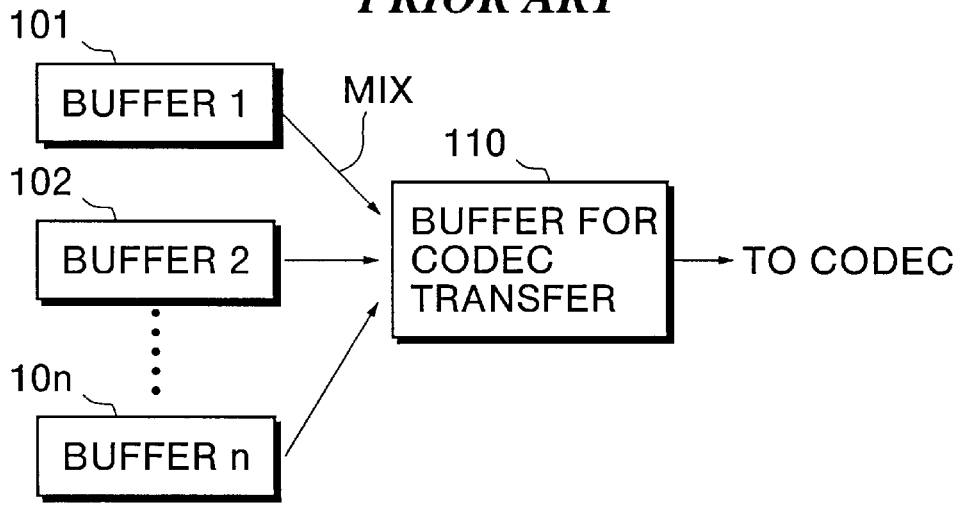
FIG.1A PRIOR ART
FIG. 1A is a view useful in explaining a conventional manner of reproducing musical tones.
Figure 1B:
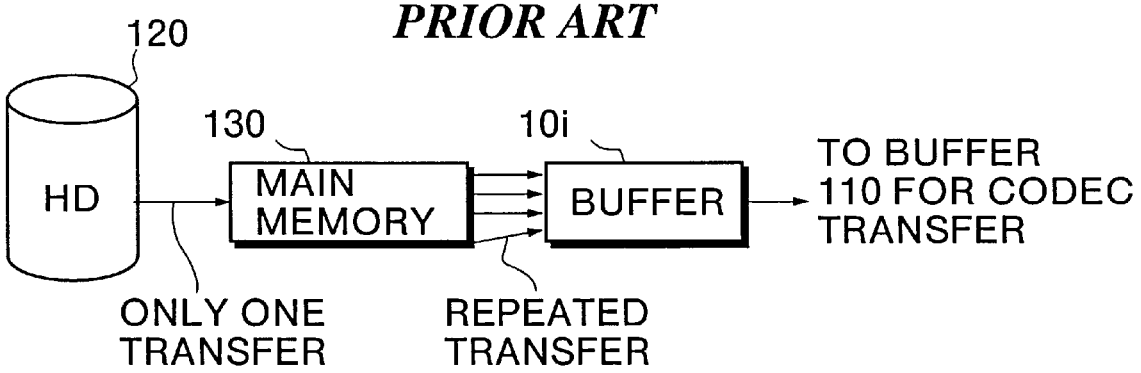
FIG.1B PRIOR ART
FIG. 1B is a view useful explaining conventional processing for reproducing static sound data.
Figure 1C:
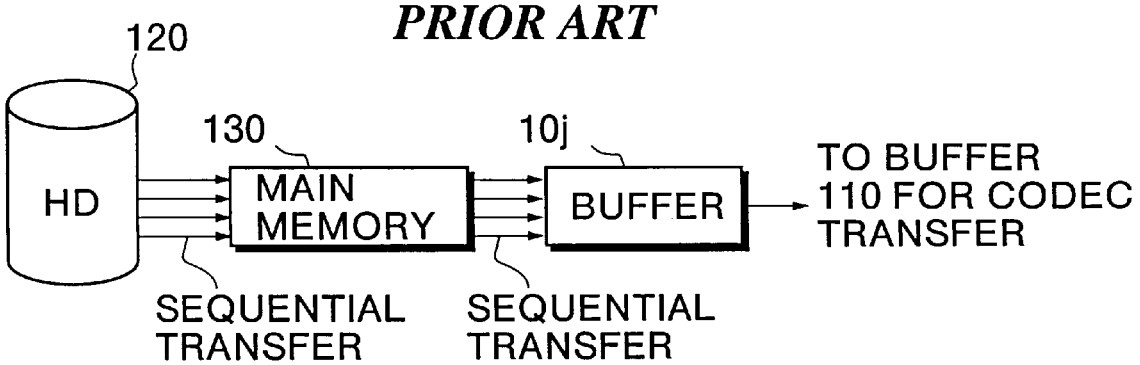
FIG.1C PRIOR ART
FIG. 1C is a view useful in explaining conventional processing for reproducing streaming sound data.
Figure 2:
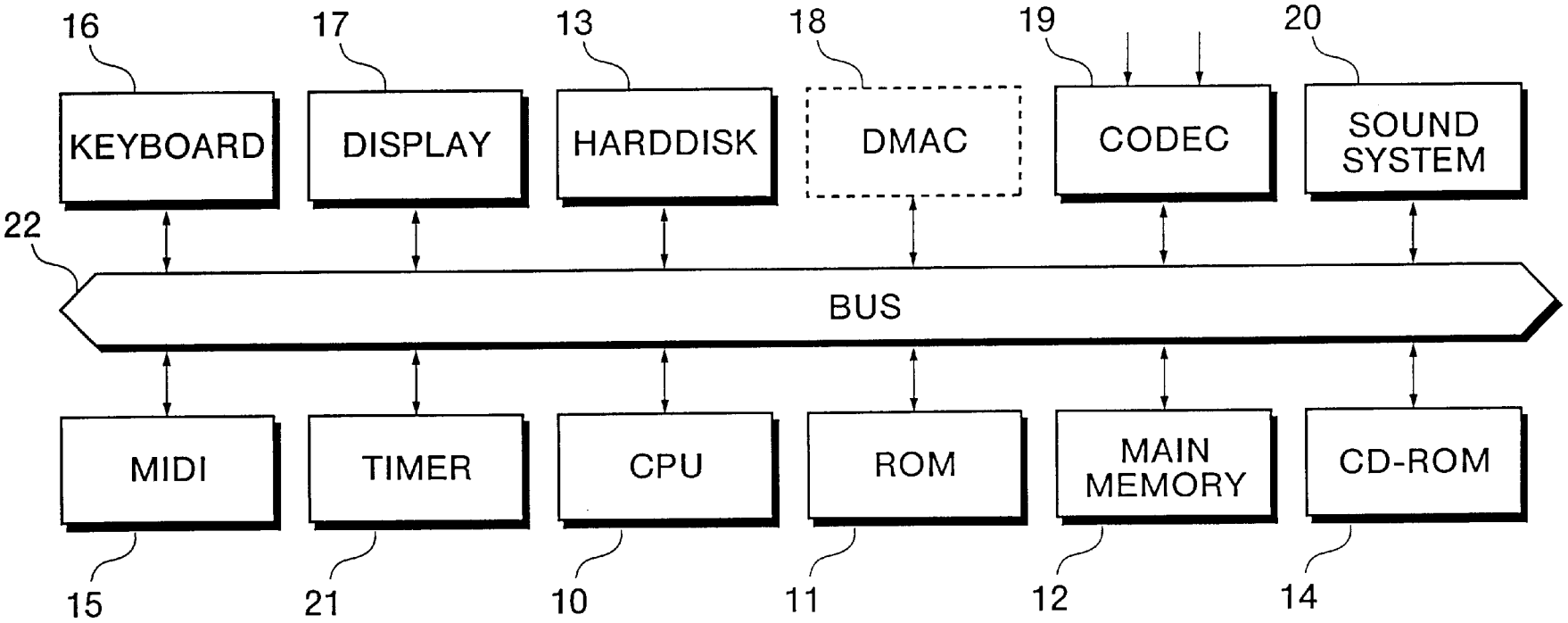
FIG. 2 is a block diagram showing the arrangement of a musical tone generating apparatus according to an embodiment of the present invention.

Referring first to FIG. 2, there is illustrated the arrangement of a musical tone generating apparatus according to one embodiment of the invention. In FIG. 2, the musical tone generating apparatus according to the present embodiment includes a central processing unit (CPU) 10 for producing musical tone waveform samples and executing various types of application programs and the like, a ROM 11 that stores preset tone color data and others, a main memory (RAM) 12 into which programs to be executed and data are read and which also provides various types of buffer areas and work areas, and a hard disk device 13 that stores various types of waveform data, tone color data, and various types of application programs, and the like. The present apparatus further includes a CD-ROM device 14 for driving CD-ROMs on which various types of data, programs and the like are stored, a MIDI interface 15 for transmitting and receiving performance data and control signals to and from an external performance device, such as a MIDI keyboard, and a keyboard 16 and a display device 17 generally included in a personal computer.

Reference numeral 18 denotes a DMA control circuit (direct memory access controller) for reading out waveform sample data from a CODEC transfer buffer area within the main memory 12 without passing through the CPU 10, and transferring the data to a coder/decoder circuit 19. This DMA control circuit 18 may be omitted if a bus 22 can transfer data at a sufficiently high speed. The coder/decoder circuit (CODEC) 19 includes a tone generator block, and is adapted to perform effects processing on musical tone waveform samples generated in the tone generator block and musical waveform sample data transferred from the above-mentioned CODEC transfer buffer, and convert the obtained musical tone waveform data into analog musical tone signals to be generated to a sound system 20. Details of this coder/decoder circuit 19 will be described later. The sound system 20 serves to amplify the musical tone signals transferred from the CODEC 19, and output the amplified musical tone signals from the apparatus. Reference numeral 21 denotes a timer 21 for interrupting the CPU 10 at predetermined time intervals and supplying a sampling clock to the CODEC 19. These component elements are connected to each other via the bus 22. The configuration explained above is equivalent to that of a generally used personal computer or workstation, for example.

Figure 3:
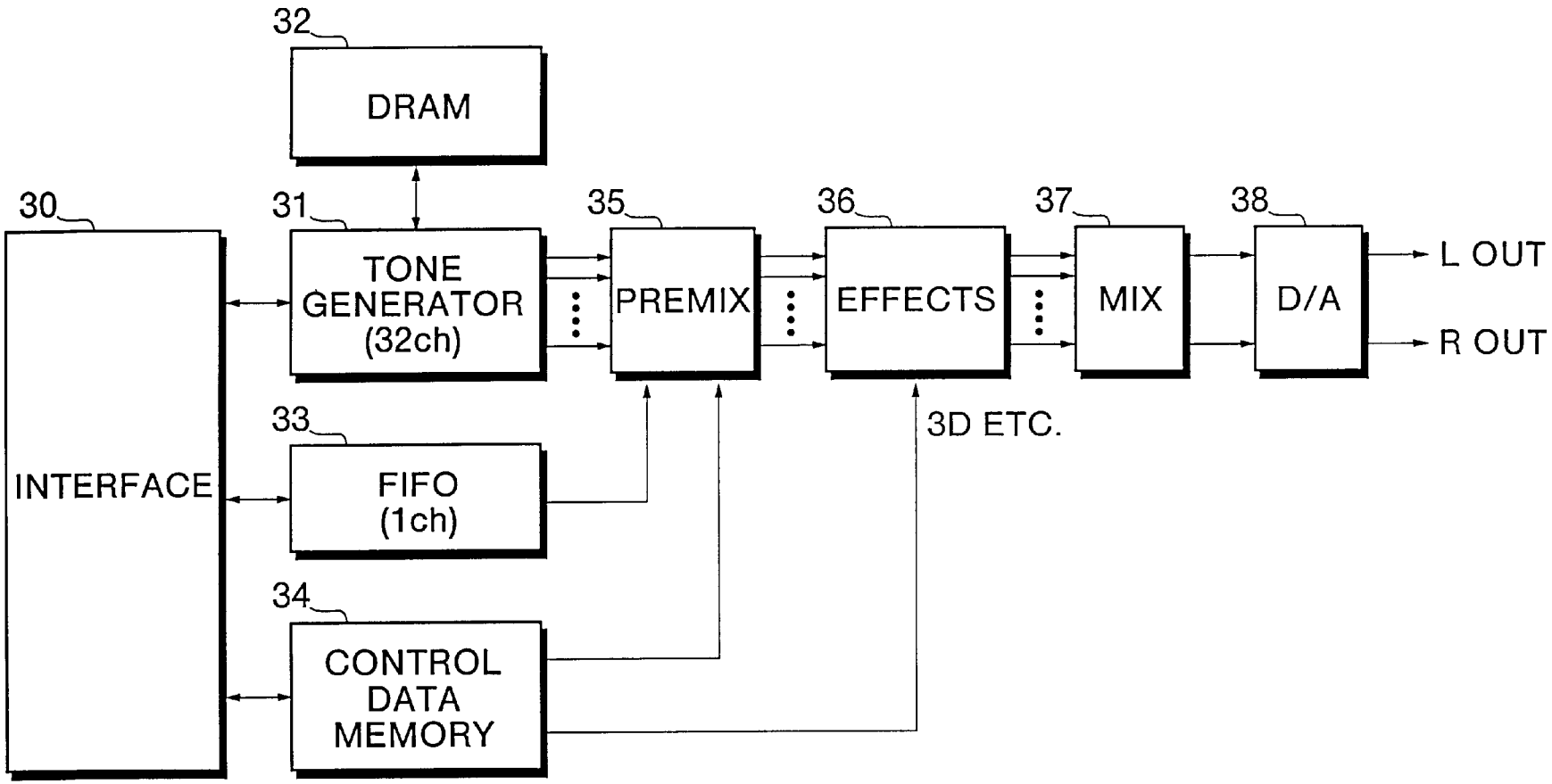
FIG. 3 is a block diagram showing the configuration of a CODEC appearing in FIG. 2.

FIG. 3 shows the configuration of the CODEC 19. The CODEC 19 includes an interface circuit 30 for transmitting and receiving various kinds of signals and data, a tone generator block 31 of waveform memory type for example, for generating musical tones based on musical tone synthesis parameters supplied via the above interface circuit 30. For example, the tone generator block 31 produces musical tone waveforms for thirty two tone-generating channels. The CODEC 19 further includes a waveform memory 32 connected to the tone generator block 31 and constituted by a DRAM, for example. In operation, a short period of musical tone waveform data is transferred via the interface circuit 30 to the waveform memory 32 under control of the CPU, and the tone generator block 31 repeatedly uses the musical tone waveform data stored in the waveform memory 32 so as to produce musical tones or sound in the above-mentioned static mode.

Streaming waveform data produced by the CPU 10 is transferred via the interface circuit 30 to and stored in a FIFO buffer 33. This FIFO buffer 33 has a capacity enough to store musical tone waveform data for one channel.

The CODEC 19 also includes a control data storage block 34 for storing control data such as parameters for effects that are transferred from the CPU 10 via the interface circuit 30. Reference numeral 35 denotes a premixing circuit which receives musical tone waveform data for each tone-generating channel generated from the above-mentioned tone generator block 31, and streaming sound data generated from the FIFO 33, and transmits these data to an effects circuit 36 while compiling channels loaded with the same effects based on effects control data from the control data storage block 34. The effects circuit 36 performs certain effects processing on each set of sound data compiled or combined for each type of effects generated from the premixing circuit 35, based on effects control data from the control data storage block 34. In this effects circuit 36, effects, such as 3D effects, are applied to the sound data.

The CODEC 9 further includes a mixing circuit 37 that receives sound data subjected to the effects processing and generated from the effects circuit 36 and mix these data, and a D/A conversion circuit 38 that converts the digital output data from the mixing circuit 37 into analog signals, which are generated as left channel signals LOUT and right channel signals ROUT.

The CODEC 19 is also provided with an external input terminal (not shown), an A/D conversion circuit (not shown) for analog-to-digital converting external stereo audio signals received through the external input terminal by sampling them at a certain sampling rate, and a FIFO buffer (not shown) for left and right channels that stores external stereo input data generated from that A/D conversion circuit. The data stored in this FIFO buffer is also read or transmitted into the CPU 10 via the above-indicated interface circuit 30.

Thus, according to the present invention, the CODEC 19 performs the processing for synthesizing the static sound data, and also performs effects processing on the static and streaming sound data. The processing for producing the streaming sound data is performed by the CPU 10.

Figure 4:
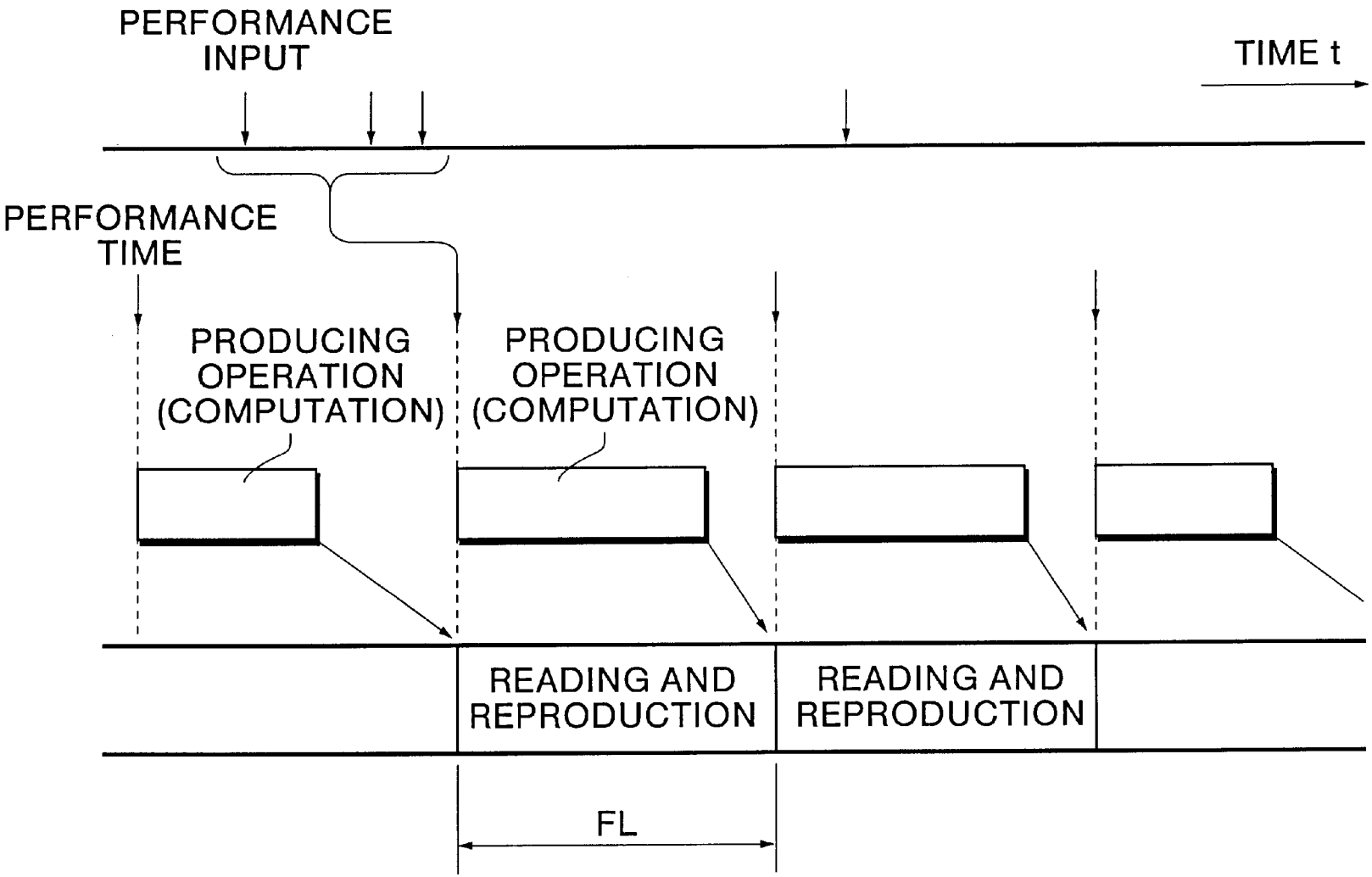
FIG. 4 is a timing chart useful in explaining a timewise flow of processing according to the embodiment.

Referring next to FIG. 4, the time flow of the process of producing streaming sound data in the musical tone generating apparatus of the present embodiment will be now explained. The musical tone generating apparatus of the present embodiment generates musical tone waveform data at a sampling frequency (rate) of 25.6 kHz, for example, but performs musical tone waveform data production processing every time period of 128 samples (one frame), for example. When performance is input from an application program in a time slot corresponding to a given frame (FL), processing to deal with the performance input is performed in the next frame, and musical tone signals are formed in the further next frame by reading out one sample of this musical tone waveform data every period of 25.6 kHz. Accordingly, a shift in time of about two frames arises from the time when the performance is input until the time when a musical tone is actually generated (or until the musical tone is eliminated), but this time shift is considered to be considerably small since one frame is equivalent to 128 samples (5 milliseconds). Although the number of samples of one frame can be set to any value, a delay may occur in tone generation if the number of samples is set to a small value. If the number of samples is set to a large value, on the other hand, the time margin is reduced and the response may be deteriorated upon a temporal increase in the amount of computing.

Figure 5:
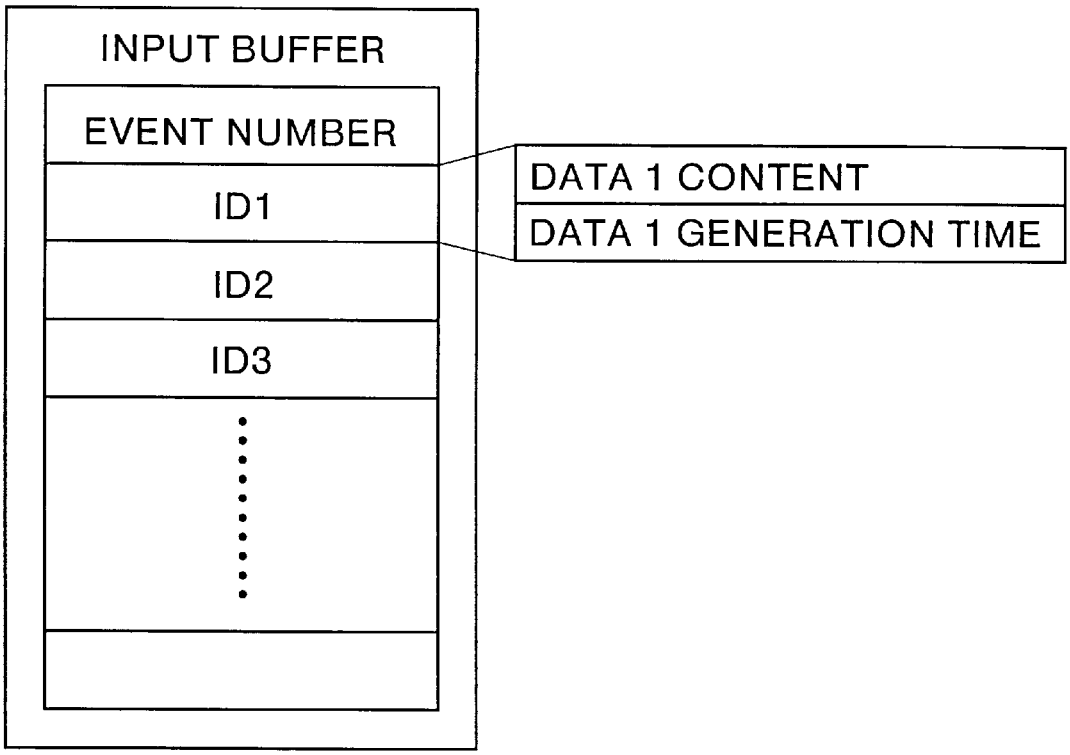
FIG. 5 is a view showing a format of data stored in an input buffer used in the embodiment.

FIG. 5 shows a format of data stored in an input buffer as one of storage areas set in the above-mentioned main memory 12. In response to an interruption that occurs when a performance input (tone generation command) is generated from an application program, the contents of the performance input and the time of its generation are written into this input buffer. The contents of this buffer are read out in tone generation start/end processing that will be described later, and the corresponding processing is executed.

Next, the operation of the musical tone generating apparatus of the present embodiment will be described referring to flow charts. The musical tone generating apparatus of the present embodiment performs musical tone generation by executing a top-priority interrupt routine shown in FIG. 6 and a main routine shown in FIG. 7.

Figure 6:
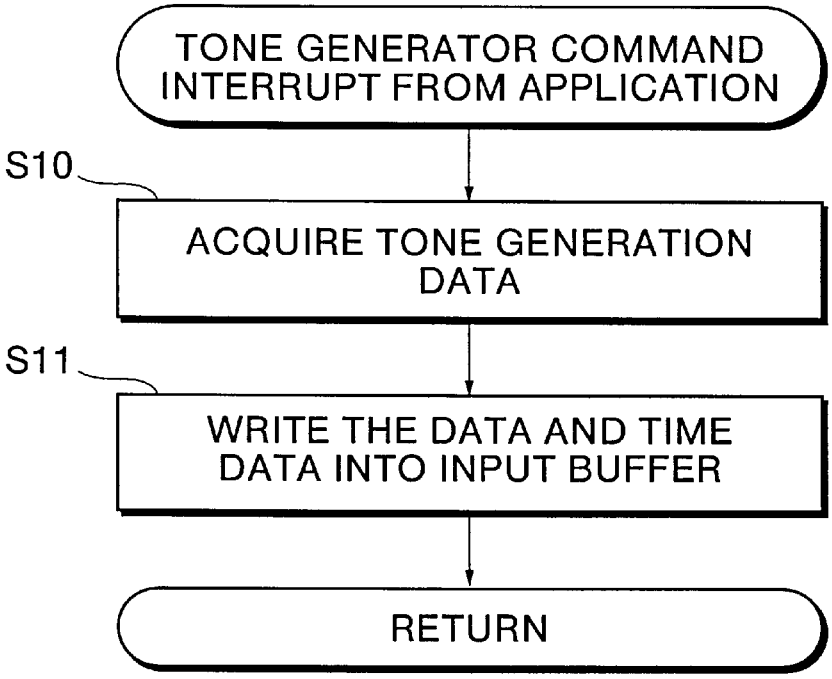
FIG. 6 is a flowchart of a tone generation command interrupt process according to the embodiment.

FIG. 6 is a flowchart of the top-priority interrupt routine. This processing is initiated when a tone generation command is received from an application program. Relevant tone generation data is received at a step S10, and the received tone generation data and data indicative of the time of receiving the data are written into the input buffer shown in FIG. 5 at a step S11. The tone generation data written into this input buffer are those in the static mode or in the streaming mode, and include all of the above-described data necessary for generating a musical tone, such as tone color data and effects data of the relevant musical tone.

Figure 7:
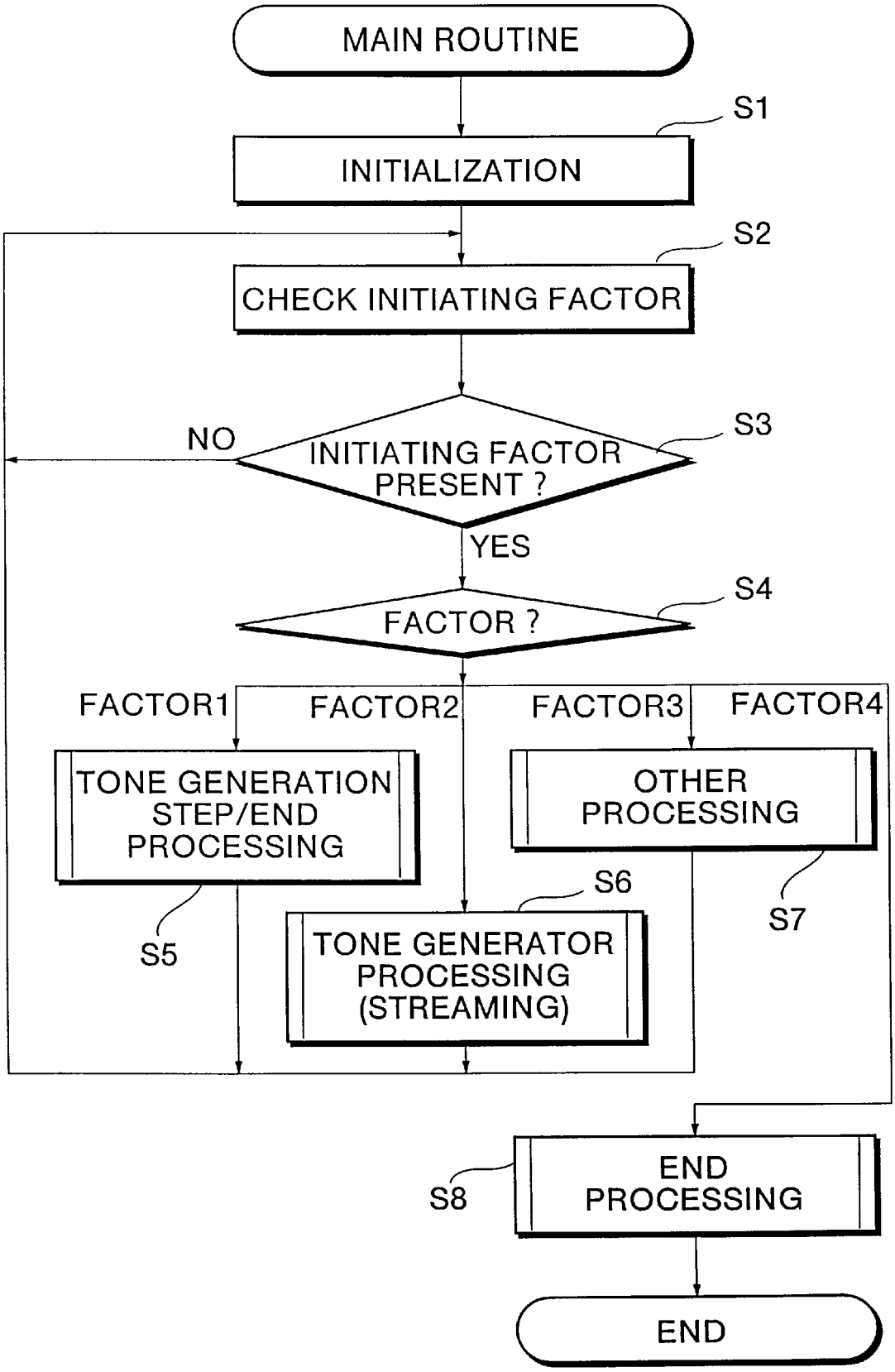
FIG. 7 is a flowchart of a main routine according to the embodiment.

FIG. 7 is a flowchart of the main routine. If the program is initiated, a step S1 is first executed to perform initialization, such as providing register areas, and then steps S2 and S3 are executed to wait for any initiating factor (trigger). In the initialization process of the step S1, waveform sample data needed for generating musical tone in the static mode is transferred to the waveform memory 32 in the CODEC 19, and a portion of the musical tone waveform samples for reproducing musical tone in the streaming mode is read out from the aforementioned hard disk device 13 or CD-ROM 14 and is stored in the main memory 12.

Upon occurrence of an initiating factor, a step S4 is executed to determine the initiating factor, and execute a corresponding processing operation. The initiating factor is one of four types of factors as follows, (1) writing of tone generation data into the input buffer, (2) an interrupt signal from the timer 21 generated at each time interval corresponding to one frame and an interrupt signal from the CODEC 19, (3) generation of a switching event from an operating panel and a window screen, and (4) inputting of an ending command. In response to occurrence of these factors, tone generation start/end processing (step S5), tone generator processing (step S6), other processing (step S7), and end processing (step S8) are executed, respectively.

End processing of the step S8 is processing such as saving of set data and clearing of registers, and the operation is terminated after this processing is finished. Other processing of the step S7 is processing corresponding to input operations of various operating elements of the operating panel and commands. Tone generator processing of the step S6 is processing executed upon detecting that reading and reproduction in FIG. 4 has proceeded to the next frame in response to an interrupt signal generated by the timer 21 after counting 128 sample clock pulses, for example. Tone generation start/end processing of the step S5 is initiated when it is detected that tone generation data is written into the above-mentioned input buffer, and includes allocation or release of a tone-generating channel in accordance with the tone generation data written into the input buffer. Tone generator processing of the step S6 is processing initiated with a period corresponding to one frame period, and includes generation of streaming sound data.

FIG. 8 schematically shows functions performed in the tone generation start/end processing of the step S5 and the tone generator processing of the step S6. Referring to FIG. 8, the tone generation start/end processing of the step S5 and the tone generator processing of the step S6 will be described in detail.

In the above-described tone generation start/end processing of the step S5, it is first determined in a block 51 whether the tone generation data stored in the input buffer includes a tone generation command for tone generation in the static mode or in the streaming mode. When this block 51 determines that the tone generation command is for tone generation in the static mode, the tone generation data in the static mode is sent to a block 52, and allocation/release processing of the tone-generating channel of the tone generator block 31 in the CODEC 19 is performed in accordance with the tone generation data. For example, when the tone generation data is for instructing generation of a new musical tone, the block 52 determines which tone-generating channel in the tone generator should be allocated to the generation of the musical tone, and when the tone generation data is for instructing stop of generation of a musical tone that has been generated, the tone-generating channel that has been generating the musical tone is selected. Then, in a block 53, all of the musical tone synthesis parameters are sent to the relevant tone-generating channel of the tone generator block 31 in the CODEC 19, and the effects parameters included in the tone generation data are sent to the control data storage block 34

When the block 51 determines that the tone generation command is for tone generation in the streaming mode, the tone generation data in the streaming mode is sent to a block 54, and the allocation/release processing of the tone-generating channel is performed in block 54. In this embodiment in which the number of tone-generating channels of the streaming mode is supposed to be n, allocation or release of the tone-generating channel corresponding to the tone generation data is carried out, and information on the allocation or release is sent out to a streaming sound data synthesis block 56. Also, the effects parameters included in the tone generation data are sent out to the CODEC 19 (block 55).

The above-described tone generator processing of the step S6 is initiated when the streaming sound data synthesis block 56 receives an interrupt signal from the timer 21 or the CODEC 19 (the starting point of each frame in FIG. 4). In this processing, a large volume of musical tone waveform sample data corresponding to the tone-generating channel, which is transmitted from the hard disk device or the CD-ROM device and loaded into the main memory, is stored in a corresponding channel area of the buffer 57. In this case, the area of the main memory is used as a double buffer, similarly to the prior art described before, such that data stored in one area is read out and written into a corresponding location in the buffer 57 while data is being written into another area. This procedure is repeated so that musical tone waveform data are read out without intermission. The musical tone waveform sample data thus stored in channel areas of the buffer 57 are mixed and transferred to a CODEC transfer buffer 58, from which they are transferred to the FIFO buffer in the CODEC 19 at predetermined time intervals. Interpolation processing may also be performed between musical tone waveform samples, if required.

In the above described manner, in response to the tone generation command for tone generation in the static mode, allocation/release of the tone-generating channel is carried out, then the performance information (such as a MIDI event) is interpreted, and musical tone synthesis parameters for generating the musical tone are produced and sent to the CODEC. On the other hand, in response to the tone generation command for tone generation in the streaming mode, allocation/release of the tone-generating channel is carried out, then streaming sound data synthesis processing is performed, and the produced streaming sound data is mixed and transferred to the FIFO buffer in the CODEC 19.

In the tone generator block 31 of the CODEC 19, a musical tone waveform sample for the allocated tone-generating channel is produced using waveform data stored in advance in the waveform memory (DRAM) 32, based on musical tone synthesis parameters sent out from the CPU in response to the tone generation command for the static mode. Namely, a waveform sample is read out from the waveform memory, based on musical tone synthesis parameters such as allocated channel, readout pitch (F number) in the waveform memory, readout interval in the waveform memory, and envelope-generating coefficients, and a predetermined interpolating operation is performed on the waveform sample thus read out, to produce an interpolated musical sound waveform sample. Then, the musical tone waveform sample for each tone-generating channel is given an envelope and then accumulated, so that the musical tone waveform data is generated at the sampling frequency (rate). In the present embodiment, the tone generator block 31 is able to produce musical tone waveform samples for thirty two channels.

The musical tone waveform data for 32 channels generated from the tone generator block 31 in this manner and the musical tone waveform data in the streaming sound mode that is transferred to the FIFO 33 as described above are received by the premixing circuit 35.

The control data storage block 34 of the CODEC 19 stores effects parameters for the streaming sound data which are sent out from the block 55 (FIG. 8), and musical tone waveform data to which the same effects are applied, out of the musical tone waveform data for respective tone-generating channels, are mixed in the premixing circuit 35 according to the output from the control data storage block 34. As a result, musical tone waveform data corresponding to the effects to be applied thereto is generated from the premixing circuit 35. The musical tone waveform data is then received by the effects circuit 36 and subjected to corresponding effects processing, or received by the mixing circuit 37 without being processed. The outputs from the effects circuit 36 are mixed in this mixing circuit 37, converted into analog signals by the D/A converter 38, and generated as output signals LOUT and ROUT of left and right channels.

In this manner, effects are applied to the musical tone waveform data of each tone-generating channel generated from the tone generator block 31, and effects processing is also performed on the streaming sound data from the FIFO buffer 33. Thus, sophisticated musical tone processing can be achieved.

While a tone generator block of waveform memory type is employed as the tone generator block in the illustrated embodiment, the present invention is not limited to this type of tone generator block. For example, other types of tone generator block, such as one storing musical tone waveform samples such as WAVE data in waveform memory, may be employed.

Although the waveform memory 32 is provided inside the CODEC 19, it may be externally attached to the CODEC 19. Furthermore, when the bus 22 is a high-speed bus such as a PCI bus, the waveform memory need not be provided in the CODEC 19, and musical tone waveforms may be synthesized in a waveform memory area provided in the main memory 12.

The present invention may be constructed such that related information, operating programs and the like for realizing the musical tone generating apparatus of the present invention are stored in the above-mentioned storage device such as a hard disk, so that the CPU 10 can read out these information and programs and store them into the RAM 12 to use them. Further, if data recorded on a portable storage medium, such as CD-ROM, floppy disk, or optical-magnetic disk, can be transferred to a storage device, such as a hard disk device, the addition (installation, etc.) and upgrading (higher version, etc.) of the related information and operating programs can be readily accomplished. Naturally, data may be directly transferred from such a portable storage medium to the RAM 12.

Moreover, when the musical tone generating apparatus of the present embodiment is equipped with a communications interface, the related information, operating programs and the like on the storage device such as a hard disk may be downloaded from a communications network via this communications interface without going through a portable recording medium. In the following, an example is presented in which related information, operating programs and the like are downloaded from a communications network.

The above-indicated communications interface is connected to a communications network such as a LAN (local area network), the Internet or a telephone line, and is connected to a server computer via the communications network. When the musical tone generating apparatus of the present embodiment, which is a client computer, does not have the related information, operating programs and the like stored in its own storage device (hard disk, etc.), this apparatus sends commands requesting the related information, operating programs and the like to the server computer via the above communications interface and communications network. When these commands are received, the server computer delivers the requested related information, operating programs and the like to the present apparatus via the communications network. The present apparatus then receives the delivered related information, operating programs and the like via the communications interface, and stores them in the storage device. Thus, downloading is completed.

Also, the present apparatus may also be realized by a commercially available personal computer or the like on which the above related information, operating programs and the like are installed. In this case, too, data, such as the related information and operating programs, may be distributed in a method selected from: a method in which the data is stored in advance in a non-volatile memory such as the ROM 11, a method in which the data is stored in a portable recording medium and distributed, and a method in which the data is distributed via a communications interface.

What is claimed is:

1. A musical tone generating apparatus comprising:

an input device that receives input performance data, said input performance data including at least a first performance data and a second performance data;

a tone generator circuit that produces musical tone waveform data in response to tone synthesis parameters;

a processing device responsive to said input performance data to produce either musical tone synthesis parameters or musical tone waveform data, wherein when said input performance data is the first performance data said processing device produces the musical tone synthesis parameters corresponding to the input performance data and supplies the parameters to said tone generator circuit, and when said input performance data is the second performance data said processing device produces the musical tone waveform data corresponding to the input performance data;

a storage device that stores the musical tone waveform data produced by said processing device, said musical tone waveform data obtained by sequentially reading out the musical tone waveform data from said storage device; and a conversion circuit that mixes the musical tone waveform data produced by said processing device and the musical tone waveform data produced by said tone generator circuit, and converts the mixed musical tone waveform data into a musical tone signal.

2. A musical tone generating apparatus as claimed in claim 1, wherein said tone generator circuit produces said musical tone waveform data by repeatedly using a short period of waveform data based on the musical tone synthesis parameters from said processing device.

3. A musical tone generating apparatus comprising:

an input device that receives input performance data, said input performance data including at least a first performance data and a second performance data;

a tone generator circuit that produces musical tone waveform data in response to tone synthesis parameters;

a processing device responsive to said input performance data to produce either musical tone synthesis parameters or musical tone waveform data, wherein when said input performance data is the first performance data said processing device produces the musical tone synthesis parameters corresponding to the input performance data and supplies the parameters to said tone generator circuit, and when said input performance data is the second performance data said processing device produces the musical tone waveform data corresponding to the input performance data;

an effects circuit for respectively applying predetermined effects to the musical tone waveform data produced by said processing device and the musical tone waveform data produced by said tone generator circuit; and a conversion circuit that mixes the musical tone waveform data produced by said processing device and the musical tone waveform data produced by said tone generator circuit, and converts the mixed musical tone waveform data into a musical tone signal.

4. A musical tone generating apparatus comprising:

an input device that receives input performance data;

a processing device responsive to said input performance data to produce either musical tone synthesis parameters or musical tone waveform data;

an encoder/decoder circuit including a tone generator circuit that generates musical tone waveform data in accordance with the musical tone synthesis parameters produced by said processing device, a buffer circuit storing the musical tone waveform data produced by said processing device, a mixing circuit that mixes the musical tone waveform data produced by said tone generator circuit and the musical tone waveform data stored in said buffer circuit, a conversion circuit that converts mixed musical tone waveform data generated from said mixing circuit into a musical tone signal, and an effects circuit for respectively applying predetermined effects to the musical tone waveform data produced by said tone generator circuit and the musical tone waveform data stored in said buffer circuit.

5. A musical tone generating method comprising the steps of:

inputting performance data including at least a first performance data and a second performance data;

producing musical tone synthesis parameters corresponding to the input performance data and supplying the musical tone synthesis parameters to a tone generator circuit for producing musical tone waveform data in accordance with the musical tone synthesis parameters when said input performance data is the first performance data, or producing musical tone waveform data corresponding to the input performance data by sequentially reading out the musical tone waveform data from a storage device that stores the musical tone waveform data produced by a processing device when said input performance data is the second performance data;

mixing the musical tone waveform data produced by said tone generator circuit and the musical tone waveform data produced by said processing device; and converting the mixed musical tone waveform data into a musical tone signal.

6. A musical tone generating method comprising the steps of:

inputting performance data including at least a first performance data and a second performance data;

producing musical tone synthesis parameters corresponding to the input performance data and supplying the musical tone synthesis parameters to a tone generator circuit for producing musical tone waveform data in accordance with the musical tone synthesis parameters when said input performance data is the first performance data, or producing musical tone waveform data corresponding to the input performance data by sequentially reading out the musical tone waveform data from a storage device that stores the musical tone waveform data produced by a processing device when said input performance data is the second performance data;

respectively applying predetermined effects to and mixing the musical tone waveform data produced by said tone generator circuit and the musical tone waveform data produced by said processing device; and converting the mixed musical tone waveform data into a musical tone signal.

7. A storage medium storing a program executable by a computer, said program comprising:

a first module that inputs performance data including at least a first performance data and a second performance data;

a second module that produces musical tone synthesis parameters corresponding to the input performance data and supplies the musical tone synthesis parameters to a tone generator circuit for producing musical tone waveform data in accordance with the musical tone synthesis parameters when said input performance data is the first performance data, or produces musical tone waveform data corresponding to the input performance data by sequentially reading out the musical tone waveform data from a storage device that stores the musical tone waveform data produced by a processing device when said input performance data is the second performance data;

a third module that mixes the musical tone waveform data produced by said tone generator circuit and the musical tone waveform data produced by said processing device; and a fourth module that converts the mixed musical tone waveform data into a musical tone signal.

8. A storage medium storing a program executable by a computer, said program comprising:

a first module that inputs performance data including at least a first performance data and a second performance data;

a second module that produces musical tone synthesis parameters corresponding to the input performance data and supplies the musical tone synthesis parameters to a tone generator circuit for producing musical tone waveform data in accordance with the musical tone synthesis parameters when said input performance data is the first performance data, or produces musical tone waveform data corresponding to the input performance data by sequentially reading out the musical tone waveform data from a storage device that stores the musical tone waveform data produced by a processing device when said input performance data is the second performance data;

a third module that respectively applies predetermined effects to and mixes the musical tone waveform data produced by said tone generator circuit and the musical tone waveform data produced by said processing device; and a fourth module that converts the mixed musical tone waveform data into a musical tone signal.

* * * * *